US011078702B2

(12) United States Patent
Babikian et al.

(10) Patent No.: US 11,078,702 B2
(45) Date of Patent: Aug. 3, 2021

(54) VARIABLE HINGE AND METHOD OF ADJUSTING THE SAME

(71) Applicant: BOBRICK WASHROOM EQUIPMENT, INC., North Hollywood, CA (US)

(72) Inventors: Dikran Babikian, Glendale, CA (US); Branko Bem, Plano, TX (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 107 days.

(21) Appl. No.: 15/873,818

(22) Filed: Jan. 17, 2018

(65) Prior Publication Data

US 2018/0223574 A1 Aug. 9, 2018

Related U.S. Application Data

(60) Provisional application No. 62/447,358, filed on Jan. 17, 2017.

(51) Int. Cl.
*E05D 11/06* (2006.01)
*E05D 3/02* (2006.01)
(Continued)

(52) U.S. Cl.
CPC ..... *E05D 11/06* (2013.01); *E05D 3/02* (2013.01); *E05D 5/10* (2013.01); *E05F 1/1215* (2013.01); *E05F 5/02* (2013.01); *E05D 5/14* (2013.01); *E05D 2003/027* (2013.01); *E05D 2005/102* (2013.01); *E05Y 2201/224* (2013.01); *E05Y 2201/484* (2013.01); *E05Y 2201/492* (2013.01); *E05Y 2800/45* (2013.01); *E05Y 2900/132* (2013.01)

(58) Field of Classification Search
CPC .. E05D 11/06; E05D 3/02; E05D 5/10; E05D 5/02; E05D 5/14; E05D 2003/027; E05D 2005/102; E05F 1/1215; E05Y 2201/224; E05Y 2201/484; E05Y 2201/492; E05Y 2800/45; E05Y 2900/132
See application file for complete search history.

(56) References Cited

U.S. PATENT DOCUMENTS 1,883,506 A * 10/1932 Bommer ..... E05F 1/1215 16/301
1,912,289 A * 5/1933 March ..... E05F 1/1215 16/279

(Continued)

*Primary Examiner* — Victor D Batson
*Assistant Examiner* — Matthew J Sullivan
(74) *Attorney, Agent, or Firm* — Lewis Roca Rothgerber Christie LLP

(57) ABSTRACT

A hinge includes a first hinge member including a first barrel, a second hinge member including a first end barrel opposite a second end barrel, a spring having a first axially extending end and a second axially extending end opposite the first axially extending end, a spring tensioner having a first depression for receiving the first axially extending end of the spring and a second depression for receiving a driver. A retainer is coupled to the spring tensioner and includes an opening that is penetrable by the driver when the driver is being received in the second depression. A method of adjusting the hinge includes compressing an end of the spring and twisting the same.

19 Claims, 10 Drawing Sheets

(51) Int. Cl.

| | |
|---|---|
| ***E05F 5/02*** | (2006.01) |
| ***E05D 5/10*** | (2006.01) |
| ***E05F 1/12*** | (2006.01) |
| *E05D 5/14* | (2006.01) |

(56) References Cited

U.S. PATENT DOCUMENTS

| | | | | | |
|---|---|---|---|---|---|
| 3,825,973 | A * | 7/1974 | Gwozdz | E05F 1/1215 | 16/300 |
| 4,073,038 | A * | 2/1978 | Curry | E05F 1/1215 | 16/301 |
| 4,419,788 | A * | 12/1983 | Prout | E05F 1/1215 | 16/300 |
| 4,628,567 | A * | 12/1986 | Brockhaus | E05D 7/105 | 16/254 |
| 8,955,194 | B2 * | 2/2015 | Teta | E05F 1/1207 | 16/222 |
| 2010/0071167 | A1 * | 3/2010 | Huang | H04M 1/0216 | 16/86 A |
| 2011/0107555 | A1 * | 5/2011 | Buchanan | E05D 7/0045 | 16/237 |
| 2017/0335613 | A1 * | 11/2017 | Stuart | E05D 5/06 | |
| 2018/0344098 | A1 * | 12/2018 | Lieb | A47K 3/36 | |
| 2018/0363347 | A1 * | 12/2018 | Chang | E05D 5/12 | |

* cited by examiner

VARIABLE HINGE AND METHOD OF ADJUSTING THE SAME

CROSS-REFERENCE TO RELATED APPLICATION

This application claims priority to and the benefit of U.S. Provisional Patent Application No. 62/447,358 filed Jan. 17, 2017, the entire content of which is incorporated herein by reference.

BACKGROUND OF THE INVENTION

Hinges used to hinge doors to a wall or a to a stile are typically two-member hinges that are coupled together and rotate relative to each other. The hinges and may be adjusted to stop their rotation relative to each other when the door opens a predetermined amount relative to the stile. Typically hinges include stops at predetermined intervals of typically 30° to 45°. Because of the range of such intervals, the adjustment of closing may not be fine-tuned and the doors may either open too much or stop opening too early.

SUMMARY

An example embodiment hinge includes a first hinge member including a first barrel, and a second hinge member including a first end barrel opposite a second end barrel, where the first barrel is coaxially aligned between the two end barrels, and where the first hinge member can rotate relative to the second hinge member about an axis along the first barrel and first and second end barrels. The example embodiment hinge also includes a spring having a first axially extending end and a second axially extending end opposite the first axially extending end, and a spring tensioner having a first depression for receiving the first axially extending end of the spring. The spring tensioner includes a second depression for receiving a driver. The spring tensioner is axially slideable along the axis. A retainer is coupled to the spring tensioner and includes an opening that is penetrable by the driver when the driver is being received in the second depression. The spring second axially extending end is rotationally retained relative to either one of the first end barrel, the second end barrel, or the first barrel, and the spring urges the spring tensioner against the retainer. When engaged with the spring tensioner, the retainer prevents the spring tensioner for rotating relative to the retainer and relative to other of the first end barrel, the second end barrel, or the first barrel. In one example embodiment, at least a portion of the spring tensioner is within the first barrel, the retainer is axially and rotationally retained relative to the barrel, and the spring second axially extending end is rotationally retained relative to the second end barrel. In another example embodiment, the hinge further includes a second cap mated to the second end barrel and being rotationally and axially retainer relative to the second end barrel. In another example embodiment, the second cap further includes a portion including a depression for receiving the second axially extending end of the spring and for rotationally retaining the second axially extending end relative to the second end barrel. In yet another example embodiment, the hinge also includes a first cap mated the first end barrel and having an opening for being penetrated by the driver when the driver is being received in the second depression. In this example embodiment, the first cap is rotationally and axially retained relative to the first end barrel. In a further example embodiment, the spring tensioner includes a plurality of grooves and projections, and the retainer includes a plurality of grooves and projections, such that the projections of the spring tensioner are received in the grooves of the retainer and the projections of the retainer are received in the grooves of the spring tensioner when the retainer engages the spring tensioner for preventing the spring tensioner from rotating relative to the retainer. In yet a further example embodiment, the spring tensioner includes a head. With this embodiment the grooves and projections of the spring tensioner are formed on the head, and the retainer includes a depression, and the projections and grooves of the retainer are formed in the depression. In another example embodiment, the spring tensioner includes a depression and the grooves and projections of the spring tensioner are formed on the depression, and the retainer includes a head and the projections and grooves of the retainer are formed on the head. In one example embodiment, the spring tensioner includes a plurality of grooves and projections, and the retainer includes a plurality of grooves and projections, such that the projections of the spring tensioner are received in the grooves of the retainer and the projections of the retainer are received in the grooves of the spring tensioner when the retainer engages the spring tensioner for preventing the spring tensioner from rotating relative to the retainer. In a further example embodiment, the spring tensioner includes a head and the grooves and projections of the spring tensioner are formed on the head, and the retainer includes a depression and the projections and grooves of the retainer are formed in the depression. In yet a further example embodiment, the spring tensioner includes a depression and the grooves and projections of the spring tensioner are formed on the depression, and the retainer includes a head and the projections and grooves of the retainer are formed on the head. In another example embodiment, the hinge also includes a first magnetic surface on the inner hinge member and a second magnetic surface on the outer hinge member. In another example embodiment, the first and second magnetic surfaces have the same polarity for repelling each other when the hinge is in a closed position. In yet another example embodiment, the inner hinge member includes a first plate member and the outer hinge member includes a second plate member. With this embodiment, the first magnetic surface is formed on the first plate member and the second magnetic surface is formed on the second plate member so as to repel each other when the hinge is in the closed position and the first and second plate members are adjacent to and face each other. In a further example embodiment, each magnetic surface is formed by inserting a magnet in the corresponding hinge members or by incorporating a magnetic paint on the corresponding hinge members.

In an example embodiment, a method is provided for adjusting the torsional stop on a hinge including a first hinge member including a first barrel, a second hinge member including a first end barrel opposite a second end barrel, where the first barrel is coaxially aligned between the two end barrels, where the first hinge member can rotate relative to the second hinge member about an axis along the first barrel and the first and second end barrels, and a spring having a first end opposite a second end, where one of the spring ends is rotationally retainer relative to the first barrel and the other spring end is rotational retained relative to either of the first or second end barrel. The method includes axially compressing one of the spring first or second ends, such that after compressing one of the spring first and second ends, the one of the spring first or second ends is not rotationally retained relative to one of the first end barrel, the second end barrel, or the first barrel. The method also includes adjusting the twist on the spring while one of the spring first or second ends is compressed by rotating the one end of the spring first or second ends relative to the other of the spring first or second ends about the axis, and axially decompressing the one of said spring first or second ends, such that after decompressing, the one of the spring first or second ends is rotationally retained relative to the one of the first end barrel, the second end barrel, or the first barrel. In another example embodiment, the first end of the spring is rotationally retained relative to the first barrel and the second end of the spring rotationally retained relative to one of the first or second end barrels, where axially compressing includes axially compressing the first end of the spring, and where adjusting the twist includes rotating the first end of the spring relative to the second end of the spring, and where axially decompressing includes axially decompressing the first end of the spring. In yet another example embodiment, the first end of the spring is rotationally retained relative to one of the first or second end barrels and where the second end of the spring is rotationally retained relative the first barrel, where axially compressing includes axially compressing the first end of the spring, and where adjusting the twist includes rotating the first end of the spring relative to the second end of the spring, and where axially decompressing includes axially decompressing the first end of the spring.

DETAILED DESCRIPTION

Figure 1A:
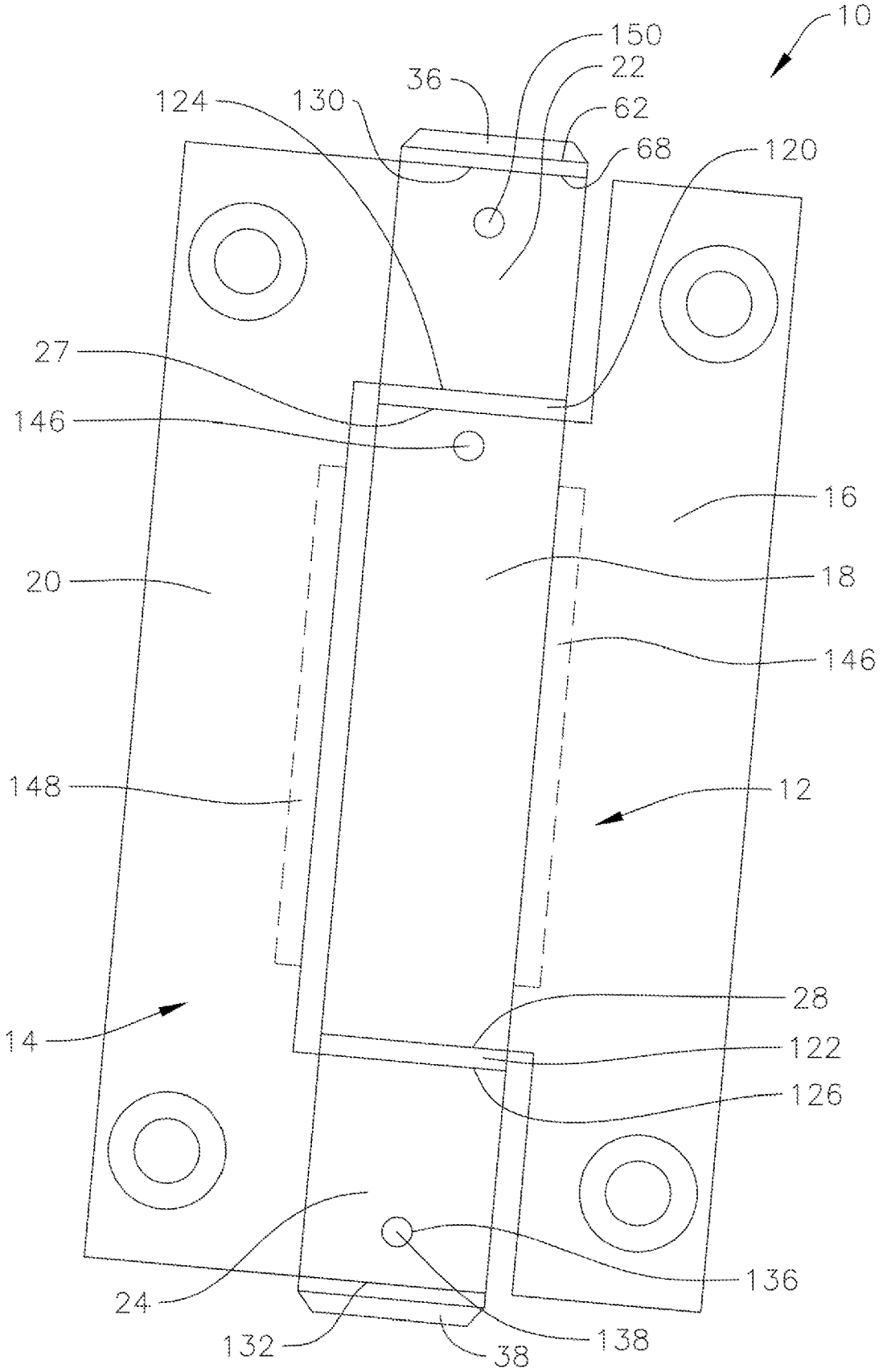
FIG. 1A is a plan view of an example embodiment hinge.
Figure 1B:
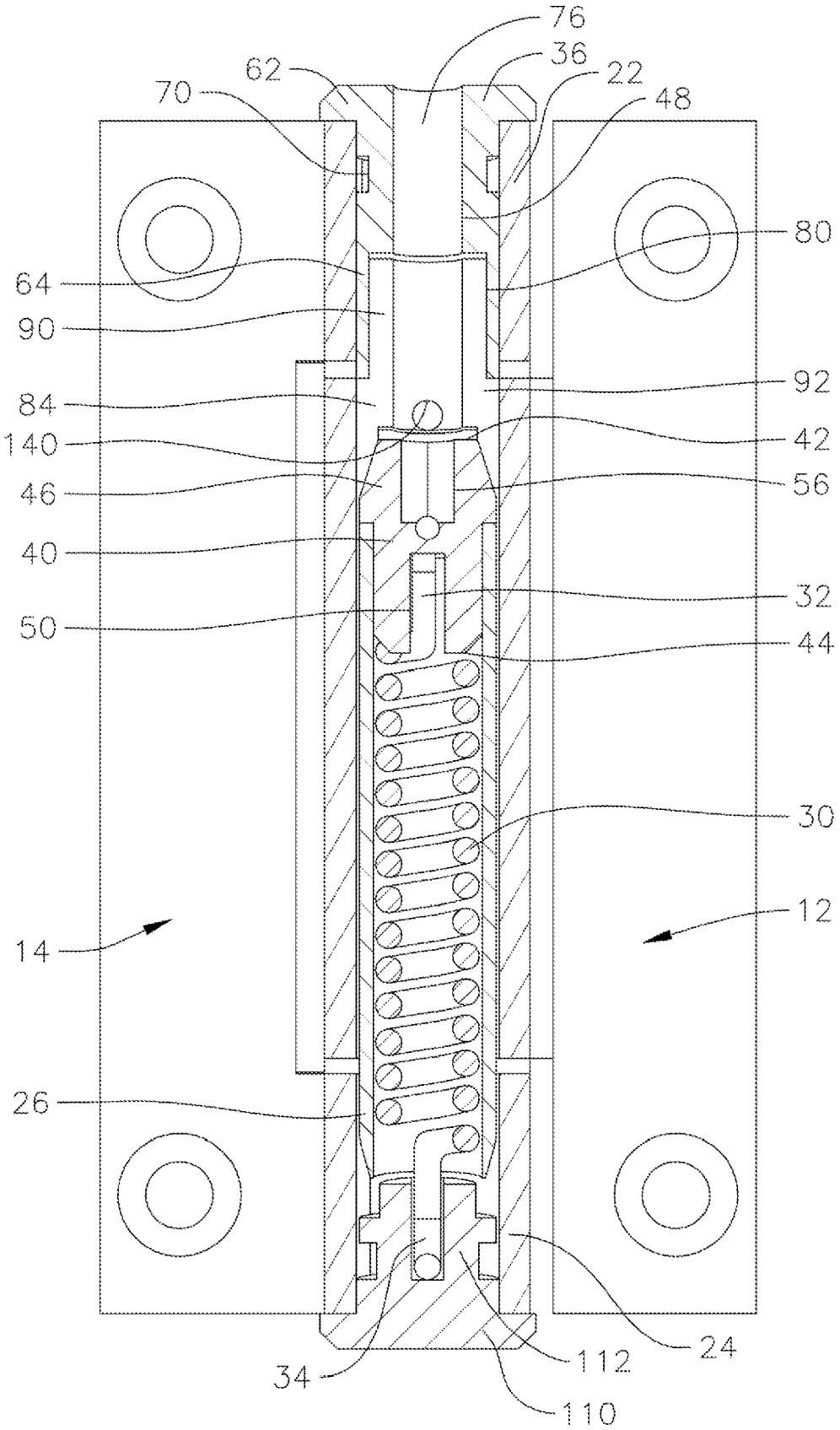
FIG. 1B is a cross-sectional view of the example embodiment hinge shown in FIG. 1A.
Figure 2:
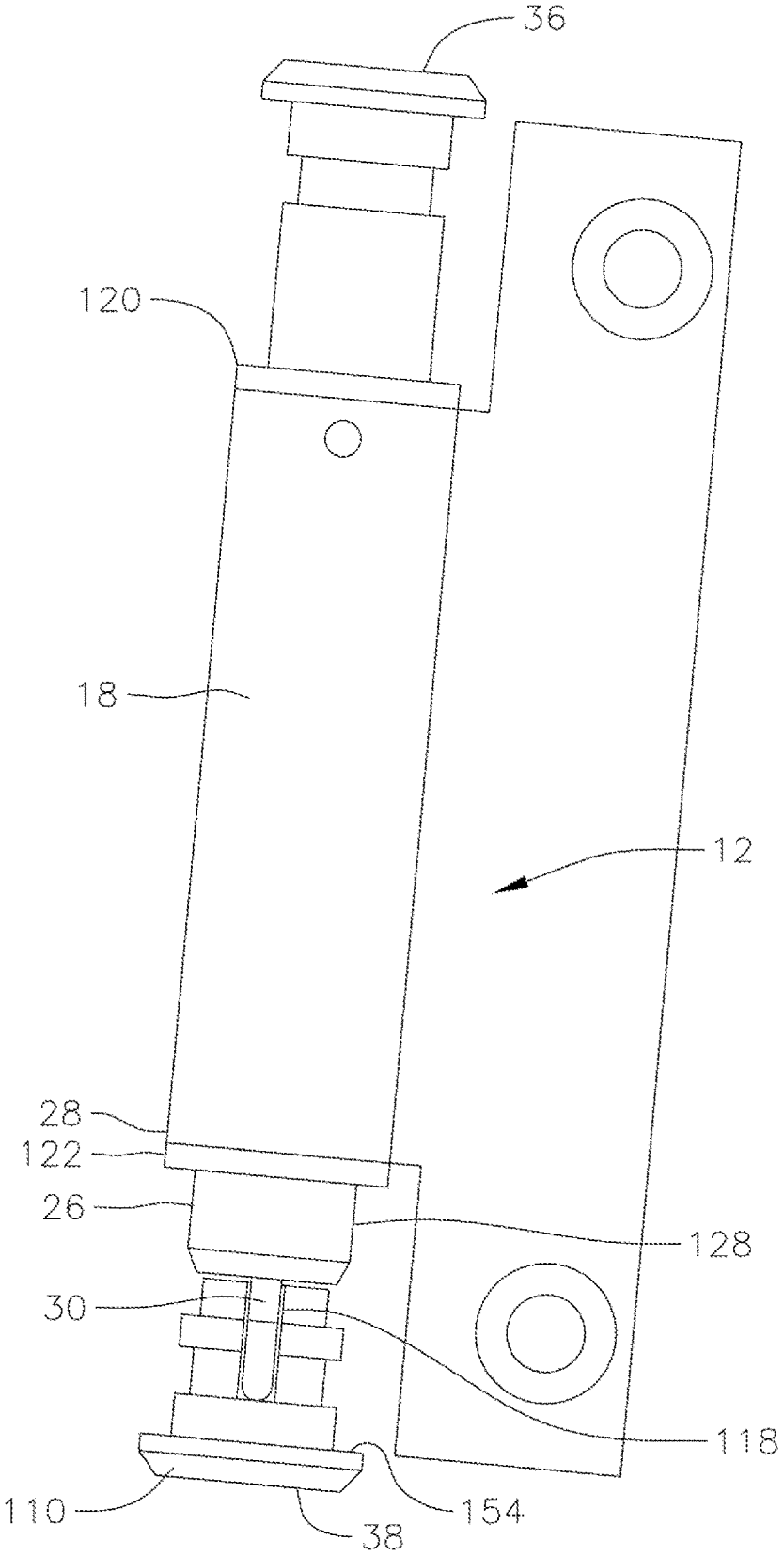
FIG. 2 is an assembly view of an example embodiment hinge with the outer hinge member removed.
Figure 3:
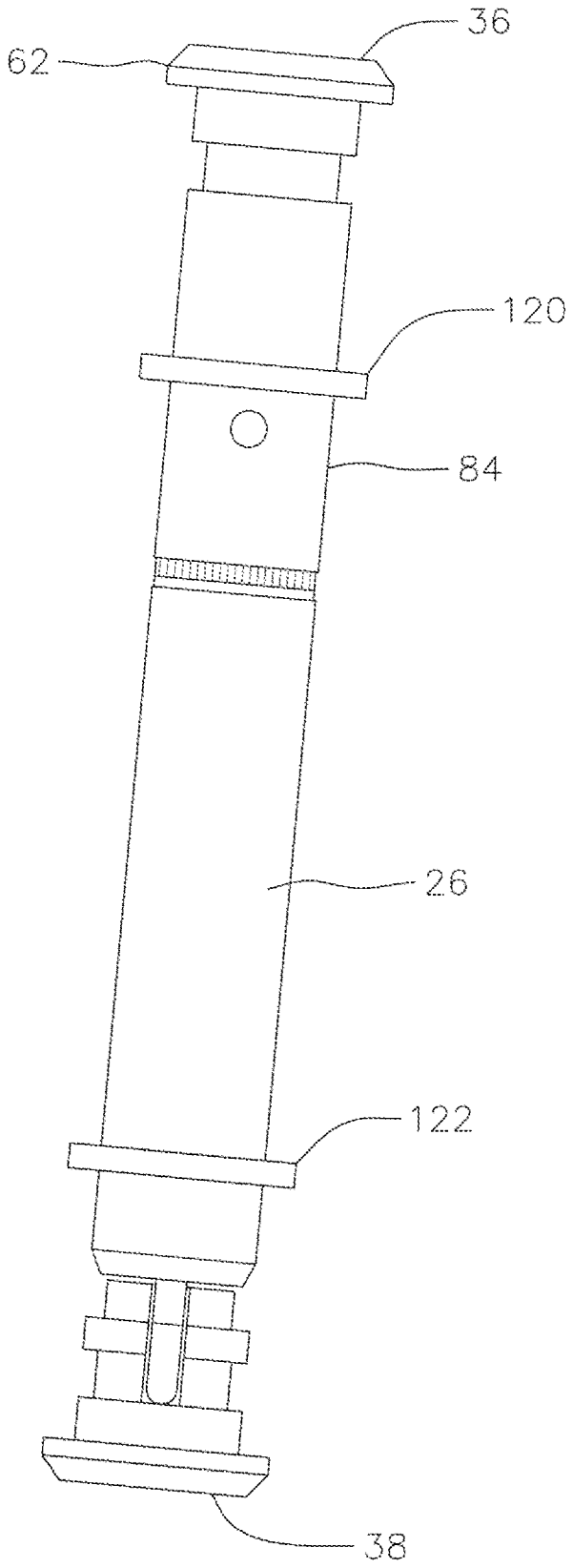
FIG. 3 is an assembly view of an example embodiment hinge with the inner and outer hinge members removed.

In an example embodiment, a hinge 10 includes an inner hinge member 12 and an outer hinge member 14, as for example shown in FIGS. 1A and 1B. The inner hinge member typically includes a plate 16 for fastening to either a stile or a door and a barrel 18 extending therefrom. The outer hinge member 14 also includes a plate 20 for attaching to the other of the stile or door and two end barrels 22, 24 spaced apart such that the barrel 18 of the inner hinge body can fit therebetween. For illustrative purposes the end barrels are referred to as a first and second end barrels and more specifically as an upper and lower end barrels. However, it should be understood that the upper and barrel may be below the lower end barrel, as for example when the hinge is upside down. When the two hinge members are coupled together, the barrel 18 of the inner hinge member is coaxially aligned between the end barrels 22, 24 of the outer hinge member. In an example embodiment, each of the barrel and end barrels are open ended cylindrical members. In the shown example embodiment the barrel and end barrels have the same outer surface diameter. In other example embodiments, they may have different outer surface diameters. In the shown example embodiment, each of the barrel and end barrels have the same inner surface diameter. A sleeve 26 is optionally fitted within the inner surface of the barrel 18 of the inner hinge member 12 and extends beyond an end 28 of the barrel so as to extend at least partially into the lower end barrel 24 of the outer hinge member (FIGS. 2 and 3). A spring 30 is fitted within the sleeve within barrel of the inner hinge member and has an upper axially extending end portion 32 within the barrel 18 of the inner hinge member 12, and a lower axially extending end portion 34 extending beyond the lower end 28 of the barrel 18 of the inner hinge member 12. A first or top cap 36 is fitted at the top end of the upper end barrel 22 of the outer hinge member 20 and a second or bottom cap 38 is fitted at a bottom end of the lower end barrel 24 of the outer hinge member 20. In other example embodiments, a sleeve is not used and the spring is fitted directly within the barrel of the inner hinge member.

The spring 30 in an example embodiment is a coil spring with the upper axially extending end portion 32 and the lower axially extending end portion 34. The end portions may be the ends of the spring bent to extend along the axis of the spring, as for example shown in FIG. 4 A spring tensioner 40 is provided having a first or top end 42 opposite as second or lower end 44. (FIGS. 1B and 5). The spring tensioner has a head 46 and a body 48 extending from the head. The head extends from the top end 42 of the spring tensioner to the body 48. The body extends from the bottom end 44 of the spring tensioner to the head. An axial slot 50 (or a depression) is formed through the body through the lower end 44. The head 46 has a conical outer surface 52. In the example embodiment shown in FIG. 5, the conical outer surface 52 is a frustum-conical outer surface. At the junction between the body and the head, the head has a greater diameter than the body, defining an annular shoulder 54 on the head. An axial depression 56 extends into the head from the first end to receive a driver such as a screw driver. The depression may be hexagonal as shown for receiving a hexagonal driver, or may be a slot for receiving a regular screw driver or may have any other shape for receiving a driver such that the driver can push and rotate the spring tensioner about its longitudinal axis. In an example embodiment, radially extending grooves 58 defining radially extending ribs 60 therebetween are formed extending radially on the frustum-conical outer surface of the head. In an example embodiment, the grooves or ribs are spaced apart at intervals of no greater than 10 degrees. In other example embodiments, they are spaced apart in intervals no greater than 5 degrees. In other example embodiments, they are spaced at intervals no greater than 3 degrees.

Figure 6A:
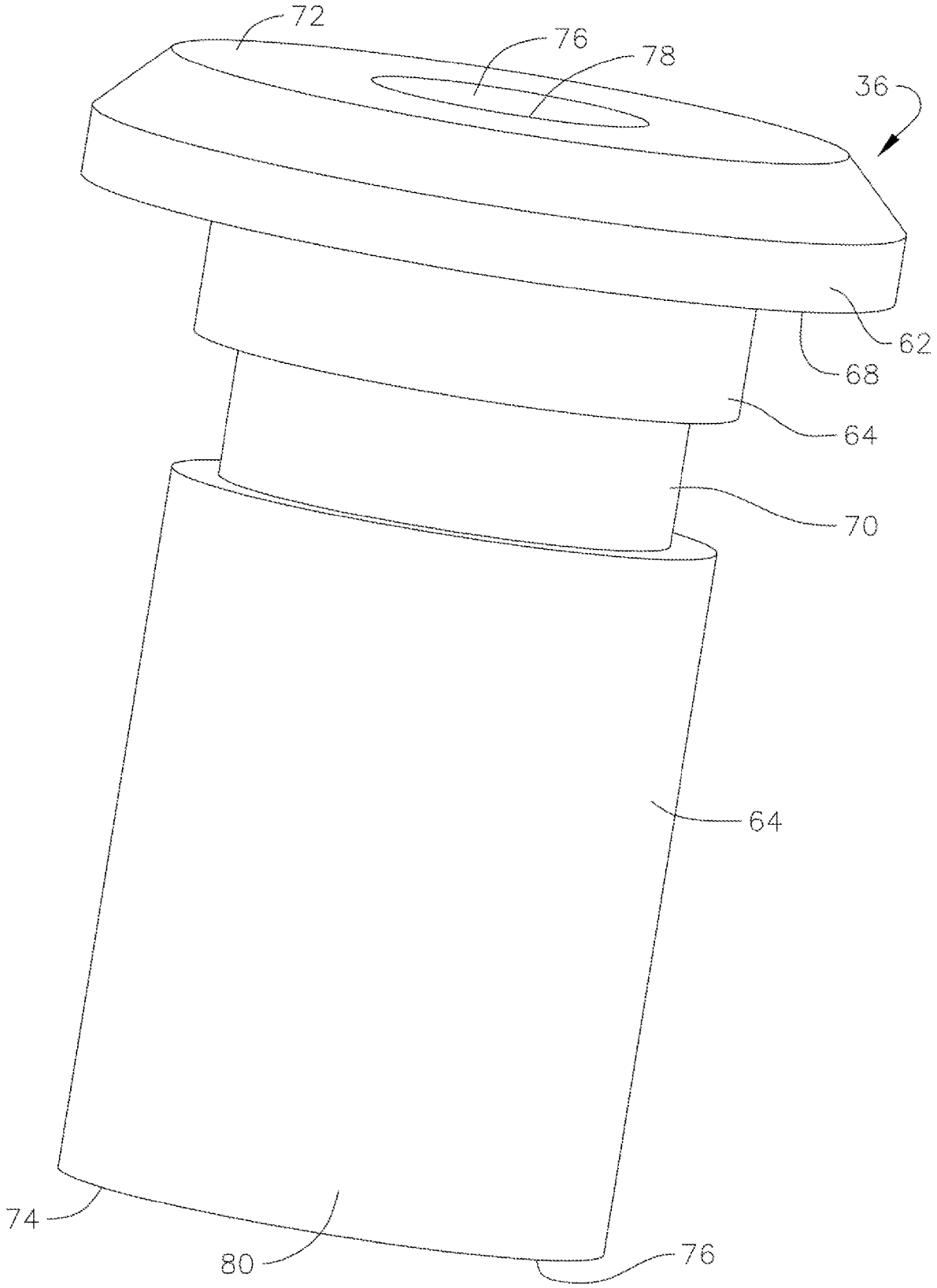
FIG. 6A is a perspective view of an example embodiment top cap for use in an example embodiment hinge.
Figure 6B:
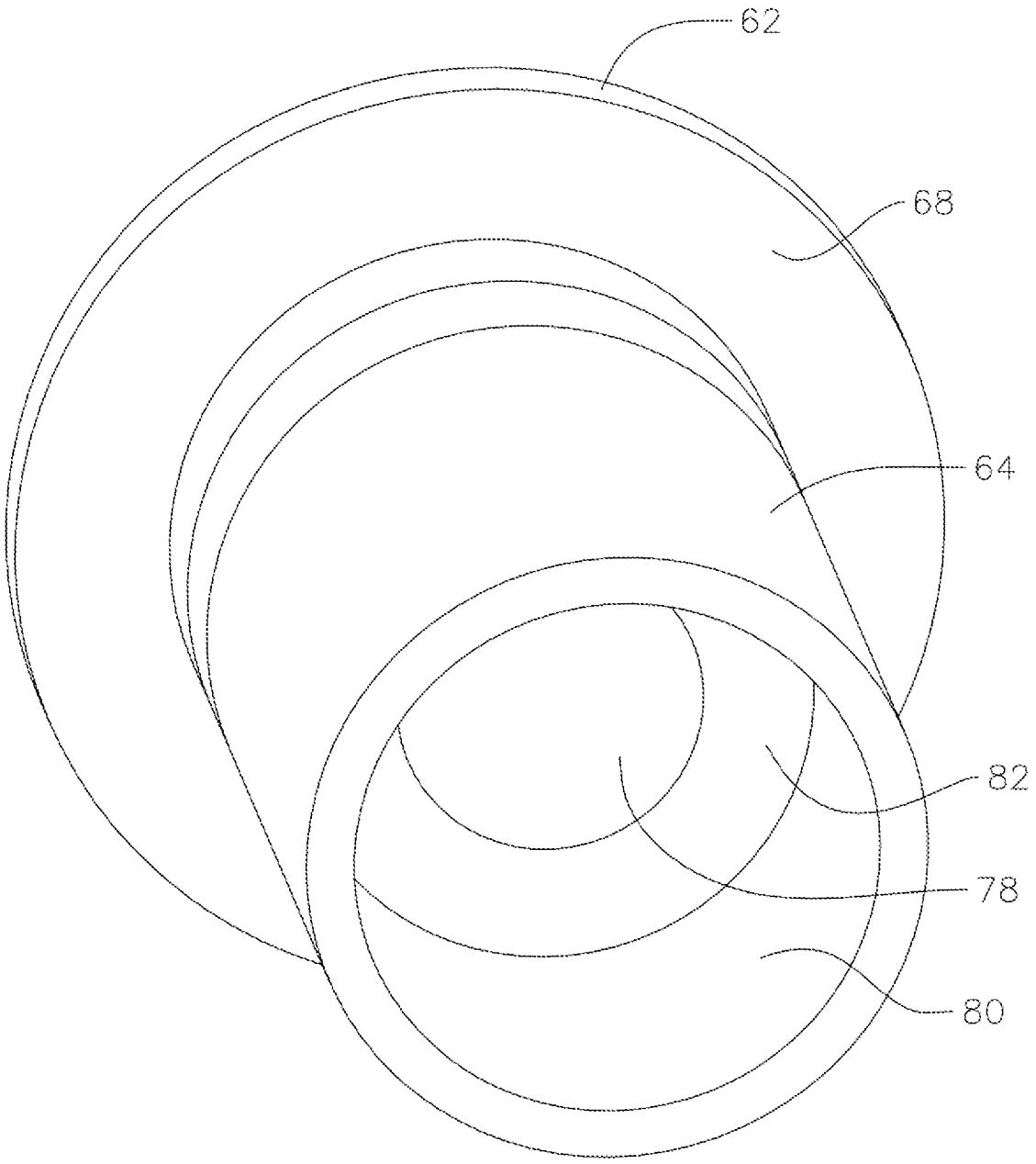
FIG. 6B is a bottom perspective view of the example embodiment top cap shown in FIG. 6A.

The top cap 36 includes a head 62 and a body 64 extending axially form the head, as for example shown in FIGS. 1B, 6A and 6B. The head at the interface with the body has a greater diameter than the body defining a top cap annular shoulder 68 at head 62 extending radially outwardly beyond the body 64. A peripheral annular depression 70 may be formed on the outer surface of the body spaced apart from the head. The top (or first cap) has a top end 72 opposite a bottom end 74. The top (or first) cap head extends axially from the top end 72 to the body 64 and the body extends axially from the bottom or lower end 74 to the head 62. An axial opening 76 extends from the top end 72 to the bottom end 74. The opening in an example embodiment includes a first portion 78 and a second portion 80. In the shown example embodiment, the first portion extends from the top end 72 to the second portion 80 which extends from the bottom end 74 to the first portion 78. The first portion has a smaller diameter than the second portion defining an annular step 82 therebetween on the first portion.

Figure 7:
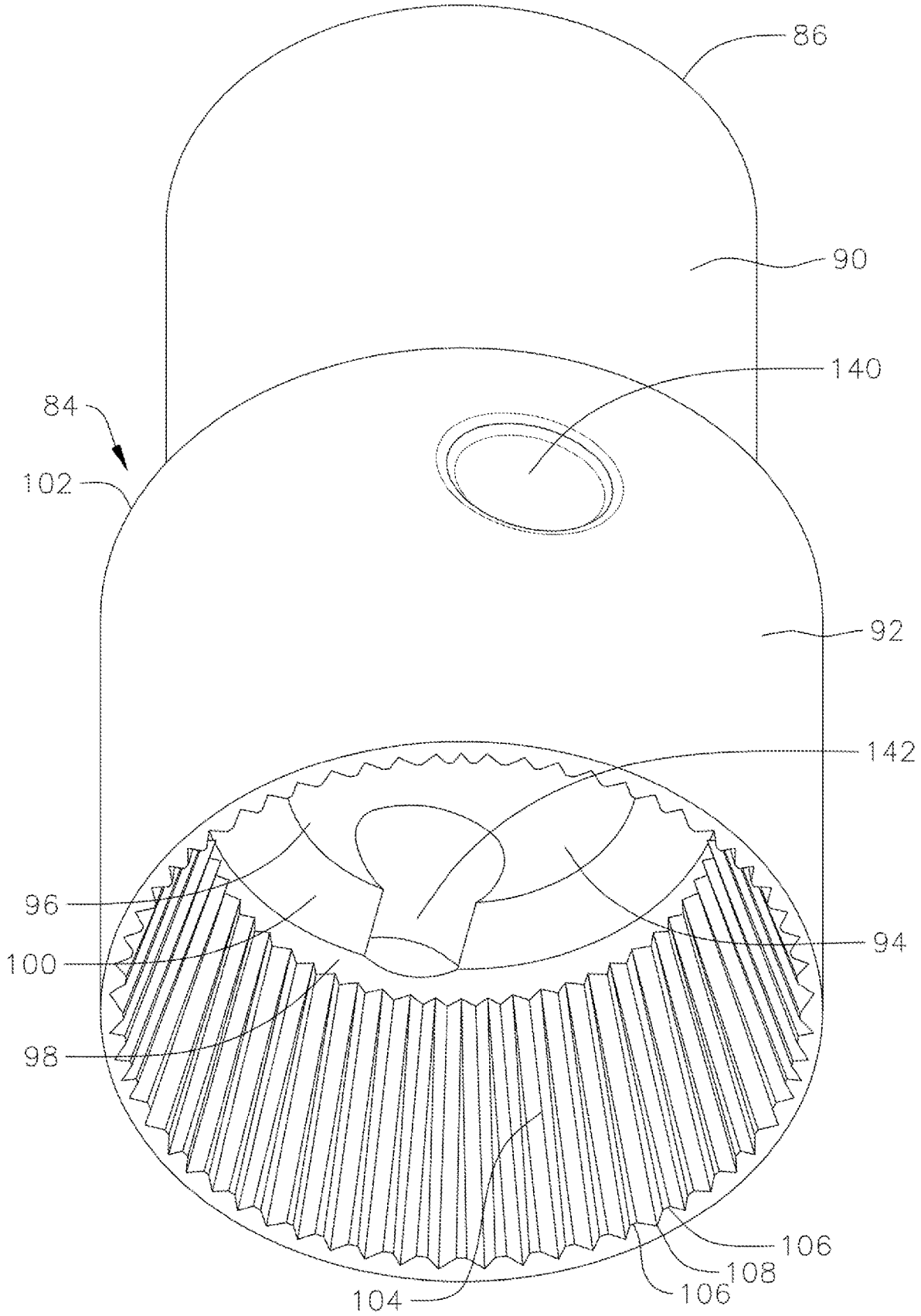
FIG. 7 is a bottom perspective view of an example embodiment retainer for use in an example embodiment hinge.

A retainer 84 is between the top cap 36 and the spring tensioner 40 (FIGS. 1B, 3 and 7). The retainer has a top end 86 opposite a bottom end 88. The retainer includes a top body portion 90 extending from the top end 86 to a bottom portion 92 extending from the bottom end 88 to the top body portion 90. An axial opening 94 extends from the top end 86 to the bottom end 88 of the retainer. The opening 94 has a first portion 96 having a first diameter and a second portion 98 extending from the first portion having a second diameter greater than the first diameter. As such an annular step 100 is formed at the first portion at the interface between the first and second portions. The first portion 90 has an outer surface diameter smaller than an outer surface diameter of the second portion 92. In this regard an external annular step 102 is formed on the second portion at the interface with the first portion. The opening second portion of the retainer has at least a portion 104 that complementary in shape to the conical outer surface 52 of the head of the spring tensioner. In the shown example embodiment the opening second portion has a frustum-conical inner surface 104 and has complementary radially extending grooves 106 and ribs 108 to the ribs 60 and grooves 58, respectively on the outer surface of the head of the spring tensioner. In this regard, the radial ribs of the spring tensioner may be received in the radial grooves of the retainer and the radial ribs of the retainer may be received in the radial grooves of the spring tensioner.

Figure 8:
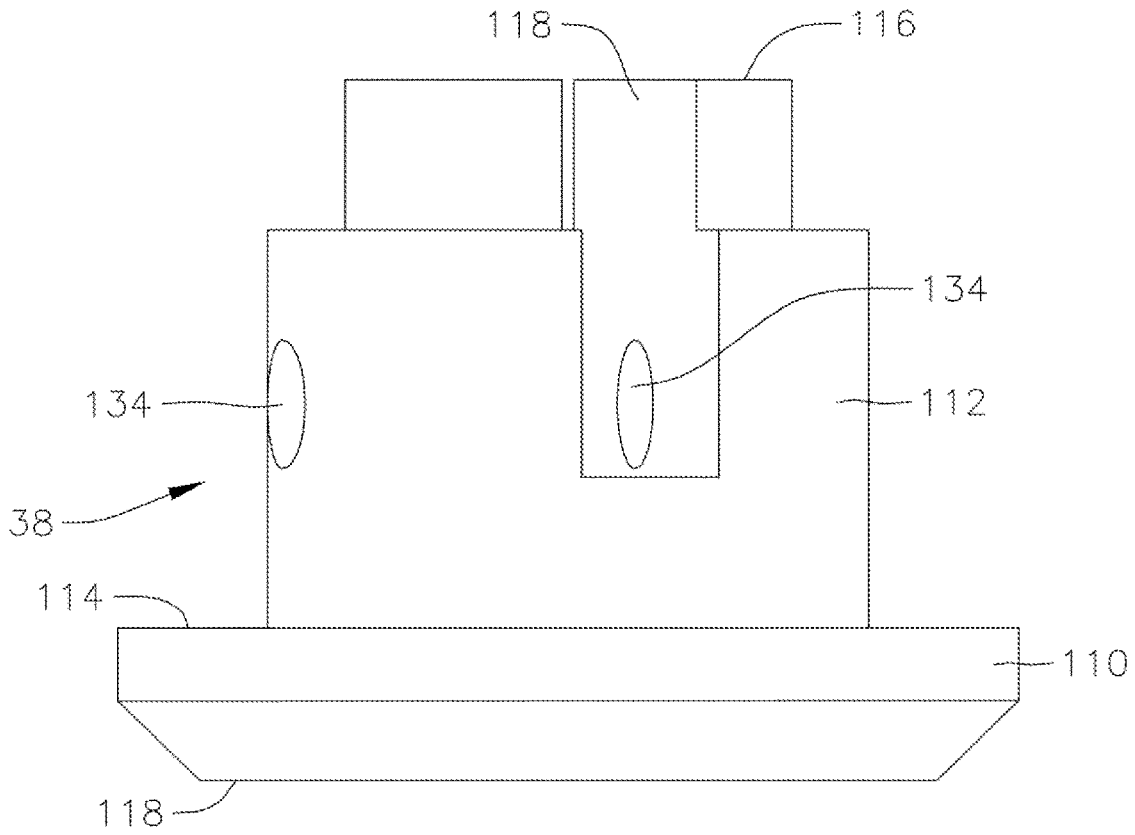
FIG. 8 is a perspective view of an example embodiment top cap for use in an example embodiment hinge.

The second or bottom cap 38 includes a head 110 and a body 112 extending axially form the head (FIG. 8). The head at the interface with the body has a greater diameter than the body defining a top cap annular shoulder 114 on the head at such interface. The bottom cap has a top end 116 and a bottom end 118. The head 110 extends from the bottom end 118 to the body 112. The body 112 extends from the top end 116 to the head 110. A slot 118 is formed across the body through the top end 116 for receiving the lower end portion 34 of the spring.

In an example embodiment, the barrel 18 of the inner hinge member 16 is placed between and aligned with the end barrels 22, 24 of the outer hinge member 20. Optional bearing washers 120, 122 may be aligned and placed between each end 27, 28 of the barrel 18 of the inner hinge member and ends 124, 126 of the end barrels 22, 24, as for example shown in FIG. 1. The bearing washers may be made of any material that reduces wear and/or friction as the barrel rotates relative to the end barrels. The sleeve 26 is slid from an open end of either of the end barrels and into the barrel 18 of the inner hinge member to a position where an end portion 128 of the sleeve extends beyond the end 28 of the barrel 18 and in the lower end barrel 24. In an example embodiment, the outer surface diameter of the sleeve is slightly smaller than the inner surface diameter of the barrel and the lower end barrel (FIG. 2). The spring 30 is fitted within the sleeve such that the opposite ends 32, 34 of the spring extend beyond opposite ends of the sleeve.

The bottom cap 38 is then fitted through the lower end barrel 24 such that the annular step 114 abuts the end 132 of the lower end barrel 24 and the spring end portion 34 is received within the slot 118 of the bottom cap. In an example embodiment, the bottom cap includes a transverse bore 134 as for example shown in FIG. 8 extending transversely across the body 112 of the bottom cap and through the slot 118. In an example embodiment a bore 136 is also formed through the lower end barrel. The bore may extend through opposite sides of the end barrel, as for example shown in FIG. 1A. When the cap is fitted into the lower end barrel, a pin 136 is fitted through the bore 136 of the lower end barrel and through the bore 134 of the cap. In an example embodiment, the pin extends through the bore 138 into the bore 134 and into an opposite bore (not shown) on the lower end barrel from bore 136 and such that it prevents rotation of the bottom cap relative to the lower end barrel it also retains caps in position. In other example embodiments, the body or another portion of the bottom cap may have a projection that it is received in a complementary depression formed in the end barrel or a projection may be formed in the end barrel that is received in a depression formed in the bottom end cap when the cap is fitted into the lower end barrel for preventing rotation of the bottom end cap relative to the lower end barrel. In another example embodiment, the bottom end cap may be retaining position by friction between an outer surface of the bottom end cap body 112 and an inner surface of the lower end barrel. In an example embodiment, instead of an opening 136, the portion of the lower end barrel where the opening 136 is formed is solid and is indented or depressed into the bore 134 of the bottom cap.

Figure 4:
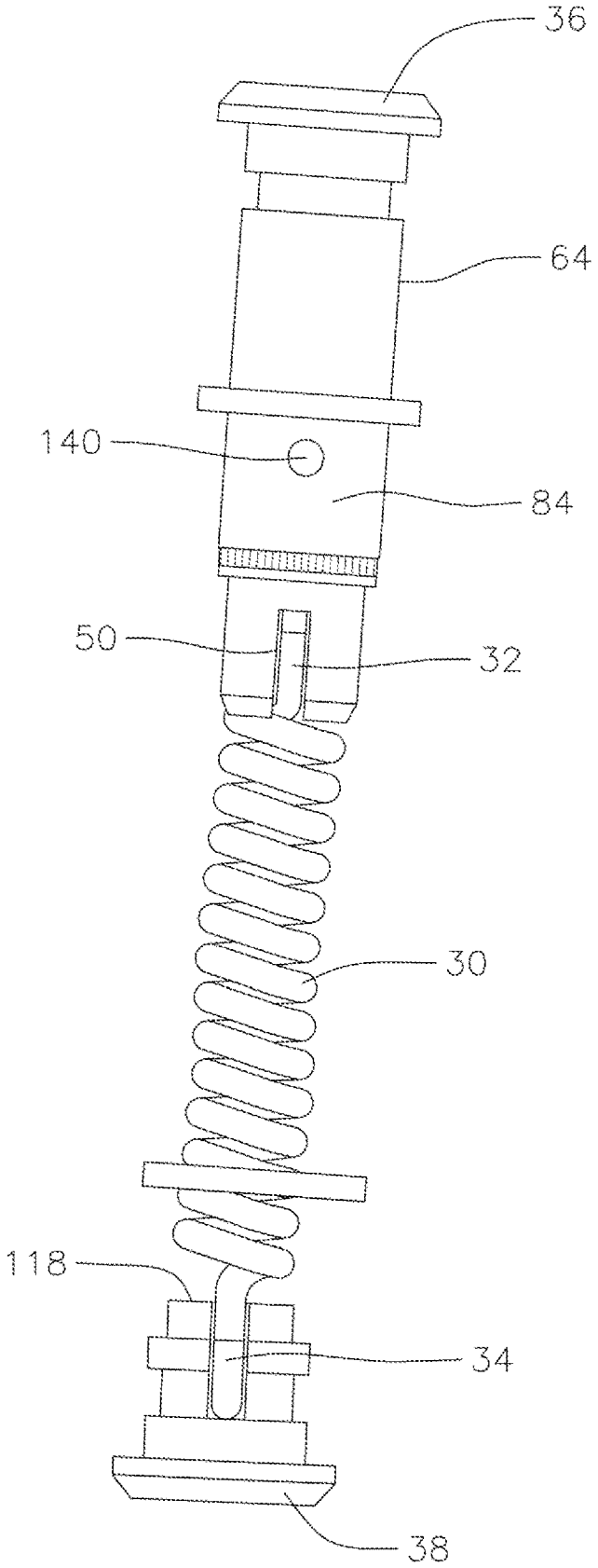
FIG. 4 is an assembly view as shown in FIG. 3 with the sleeve also removed.
Figure 5:
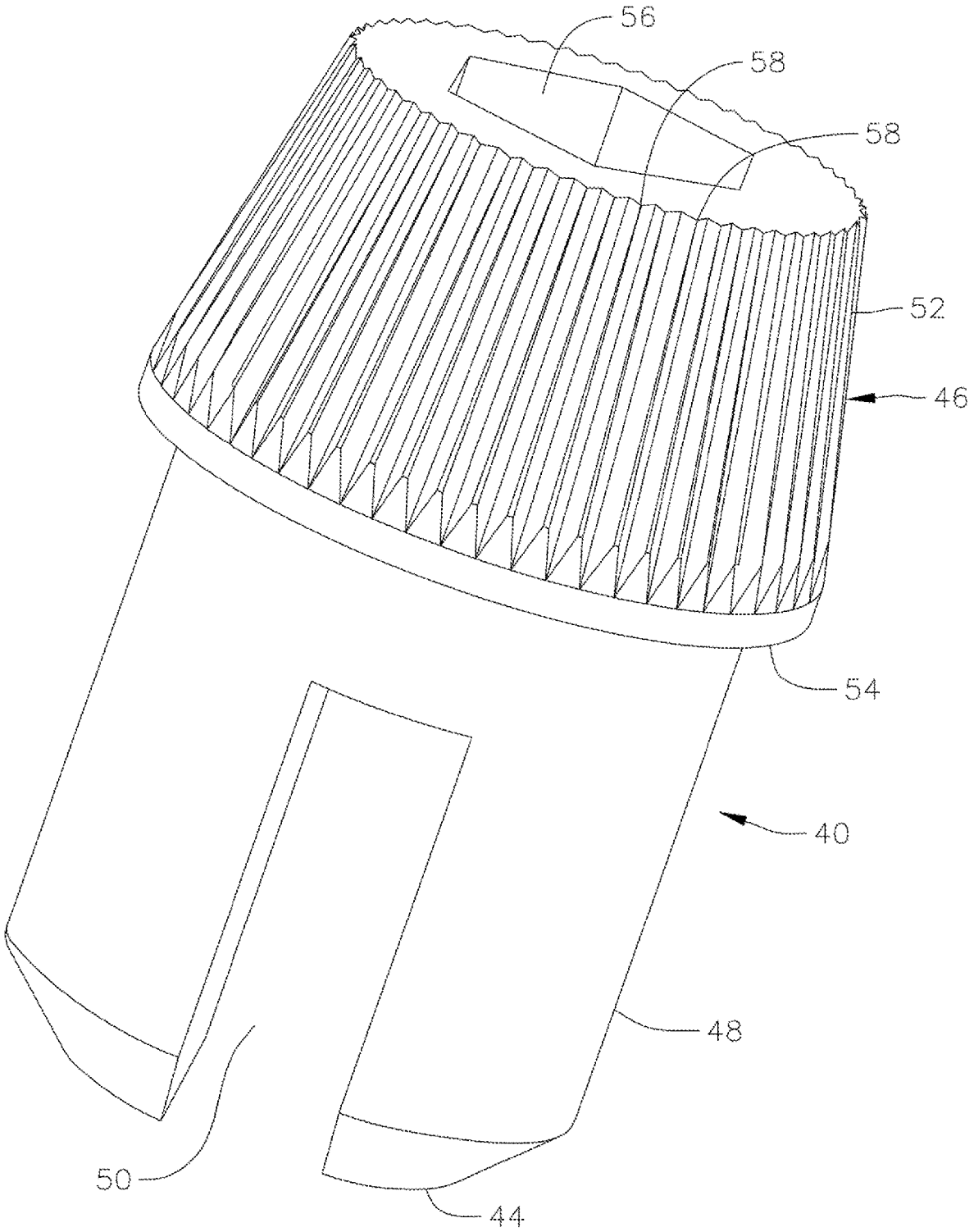
FIG. 5 is a perspective view of an example embodiment spring tensioner for use in an example embodiment hinge.

The spring tensioner 40 is fitted through the upper end barrel 22 and into the barrel 18 such that the spring end portion 32 is received within the slot 50 of the spring tensioner (FIG. 4). In an example embodiment, the retainer 84 is fitted over the spring tensioner such that the frustum-conical inner surface 104 of the retainer mates with the frustum-conical outer surface 52 of the head of the spring tensioner. In an example embodiment, the retainer includes two opposite transverse bores 140, 142 formed diametrically across each other through the bottom portion 92 of the retainer. In an example embodiment, indentations 146 may be formed on the proximity upper end 120 of the barrel. These indentations are formed diametrically opposite each other. When the retainer is mated over the spring tensioner, it is aligned such that the indentations 146 are received within their corresponding bores 140, 142 so as to lock or hold the retainer in position and preventing it from rotating relative to the barrel 18 and from moving axially relative to such barrel. In an example embodiment, the indentations 146 are formed after the retainer is positioned in the barrel. In other example embodiments, instead of indentations, openings may be formed where the indentations are and pin(s) may be pushed through such opening to retain the retainer relative to the barrel. In other example embodiments, a groove may be formed on the retainer and a projection may be formed on the barrel proximity upper end 120 which is received in such groove for retaining the retainer relative to the barrel. In another example embodiment, a depression may be formed on the barrel and a projection may be formed on the retainer such that the projection is received within the depression for retaining the retainer within the barrel.

The top cap 36 is then fitted through the upper end 130 of the upper barrel end and is mated with the top body portion 90 of the retainer. In an example embodiment, the top cap bottom end 74, mates with the annular shoulder 102 of the retainer while the head 62 of the top cap mates with the upper end 130 of the top end barrel such that the annular shoulder 68 rests against the top end 130. The top body portion 90 of the retainer is received in the opening second portion 80 of the top cap. In an example embodiment, a detent 150 may be formed at different locations around the upper end barrel proximate the top end of the upper end barrel. An example embodiment, two detents are formed opposite each other. When the top cap is fitted into the upper end barrel and to the retainer, the detents mate with the depression 70 of the top cap to retain the top cap in place relative to the upper barrel. In other example embodiments, a pin or pins may be fitted through openings at the locations of the detents that are received into the depression 70.

To change the rotational torsion of the spring 30, a driver for mating with the axial depression 56 on the spring tensioner is used. In the example embodiment, where the axial depression 56 is hexagonal, a hexagonal driver is used. The hexagonal driver is inserted through the opening 76 of the top cap through the opening 94 of the retainer and into the axial depression 56 of the spring tensioner and pushed to compress the spring tensioner and the spring 30 and to push the head 46 conical surface 52 away from the conical inner surface 104 of the retainer such that the grooves and ribs of the spring tensioner disengage from the corresponding ribs and grooves of the retainer and then the spring tensioner is rotated by rotating the driver to provide the amount of requisite twist and rotational torsion on the spring relative to the bottom cap. The spring with spring tensioner are then allowed to axially decompress upward and the ribs and grooves of the spring tensioner engage with the ribs and grooves of the retainer while retaining the requisite twist and rotational force. In this regard, the twist on the spring may be adjusted incrementally based increments of ribs and grooves in the spring tensioner and the retainer.

In another example embodiment, instead of the inner surface of the bottom portion 92 of the retainer 84 being frustum-conical including ribs and grooves, the surface may be a relatively smooth surface and the head of the spring tensioner 40 may also be frustum-conical may also have a relatively smooth surface but may be such that when it engages the frustum-conical surface of the retainer, the friction between the two surfaces is sufficient for rotationally locking the spring tensioner relative to the retainer based on the axial spring force provided by the spring. Thus, the surfaces may be made of a material that provides sufficient frictional force and/or the surface may have a roughness that provides for sufficient frictional force. In one example embodiment, the two surfaces are inclined to form the frustum-conical shape at different angles. This will allow for an infinite number of torsional incremental adjustments of the spring. The more twist or rotational torsion put on the spring, the less amount the hinge member can rotate relative to each other when opening the door which is mounted on one hinge member.

In other example embodiments, instead of the spring tensioner having a head, the spring tensioner has a depression for receiving a head of the retainer. The head and depression may be formed with complementary grooves and ridges for engaging each other, or their surfaces may be made of a material or have a roughness for providing sufficient friction. In other example embodiment, the engaging surfaces of the spring tensioner and the retainer do not have to be frustum-conical. They may for example be flat or cylindrical or any other shape that allows the two surface to engage and to rotationally retain each other by using projections and depressions or friction.

In other example embodiments, the retainer may be rotationally and axially fixed to one of the end barrels. The spring end not engaged by the spring tensioner may be then rotationally fixed relative to the barrel. In other example embodiments, the retainer may be integrally formed with the barrel or an end barrel.

Figure 9:
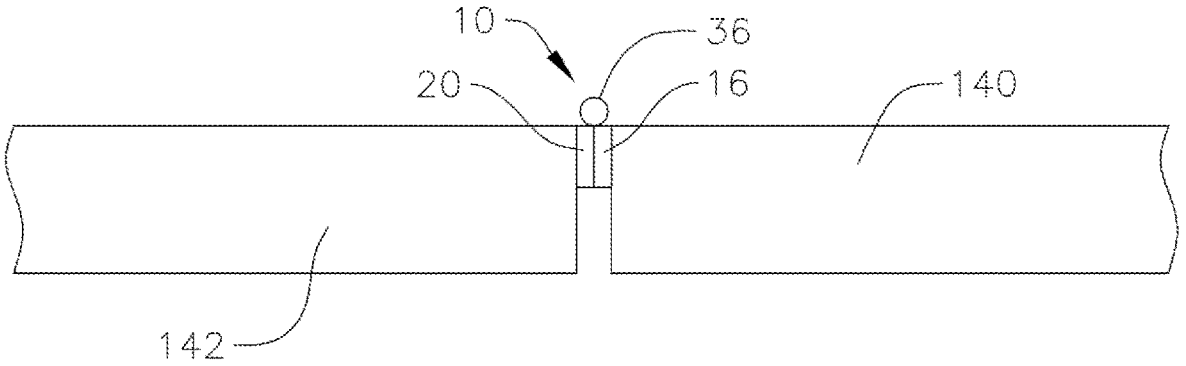
FIG. 9 is a partial top view of an example embodiment hinge mounted to a door and stile.

When a door 140 is mounted to a stile 142 using an example embodiment hinge 10, when the door is closed relative to the style, as for example shown in FIG. 9, the plate members 16 and 20 of the adjacent hinge members are adjacent each other. In an example embodiment, in order to soften the closing of the door created by the spring, magnets 146, 148 of the same polarity may be positioned on the plate members 16 and 20, respectively as for example shown in FIG. 1A. In an example embodiment, a groove may be formed in each of the flat members and strip of magnet may be inserted therein. In other example embodiments, a magnetic paint may be used. In other example embodiments, the first magnet 146 may be, for example, positioned at the intersection of the barrel 18 and the plate 16 on the inner hinge member and the second magnet may be placed adjacent the barrel 18 on the outer hinge member plate member 20. In other example embodiments at least a section of each plate member 16, 20 or of each hinge member 12, 14 has a magnetic coating on them of the same polarity. Thus, as the door closes, the two magnets will repel each other to soften the close against the spring force.

It should be noted that the terms upper, lower top, bottom, have been used for illustrative purposes. These terms should not interpreted as to mean the exact position of an object but to denote the relative positions of objects. For example, an upper portion of an object may be higher than a lower portion of an object, as for example when the object is rotated upside down.

While the present disclosure has been described with respect to a limited number of embodiments, those skilled in the art, having benefit of this disclosure, will appreciate that other embodiments and modifications can be devised which do not materially depart from the scope of the invention as disclosed herein. All such embodiments and modifications are intended to be included within the scope of this disclosure as defined in the following claims.

The invention claimed is:

1. A hinge comprising:

a first hinge member comprising a barrel;

a second hinge member comprising a first end barrel opposite a second end barrel, wherein the barrel is coaxially aligned between the two end barrels, wherein the first hinge member can rotate relative to the second hinge member about an axis along said barrel and first and second end barrels;

a spring having a first end and a second end opposite the first end;

a spring tensioner coupled to the first end of the spring, wherein said first end of the spring is rotationally retained relative to the spring tensioner, said spring tensioner comprising a depression for receiving a driver, said spring tensioner being axially slideable along the axis when being pushed by said driver;

a retainer coupled to the spring tensioner and comprising an opening that is penetrated by the driver when said driver is being received in the depression, wherein the spring second end is rotationally retained relative to the second end barrel, wherein the spring urges the spring tensioner against the retainer, and wherein when engaged with the spring tensioner, the retainer prevents the spring tensioner from rotating relative to the retainer and relative to the barrel, and wherein when being pushed by said driver, said spring tensioner slides along the axis for axially disengaging from said retainer; and a first cap mated the first end barrel and having an opening for being penetrated by the driver when said driver is being received in the depression.

2. The hinge as recited in claim 1, wherein at least a portion of the spring tensioner is within the barrel.

3. The hinge as recited in claim 1, wherein the spring tensioner comprises a plurality of grooves and projections, and wherein the retainer comprises a plurality of grooves and projections, wherein the projections of the spring tensioner are received in the grooves of the retainer and the projections of the retainer are received in the grooves of the spring tensioner when the retainer engages the spring tensioner for preventing the spring tensioner from rotating relative to the retainer.

4. The hinge as recited in claim 3, wherein the spring tensioner comprises a head and wherein said grooves and projections of said spring tensioner are formed on said head, and wherein the retainer comprises a depression and wherein said projections and grooves of said retainer are formed in said depression.

5. The hinge as recited in claim 3, wherein the spring tensioner comprises a depression and wherein said grooves and projections of said spring tensioner are formed on said depression, and wherein the retainer comprises a head and wherein said projections and grooves of said retainer are formed on said head.

6. The hinge as recited in claim 1, wherein the spring tensioner comprises a plurality of grooves and projections, and wherein the retainer comprises a plurality of grooves and projections, wherein the projections of the spring tensioner are received in the grooves of the retainer and the projections of the retainer are received in the grooves of the spring tensioner when the retainer engages the spring tensioner for preventing the spring tensioner from rotating relative to the retainer.

7. The hinge as recited in claim 6, wherein the spring tensioner comprises a head and wherein said grooves and projections of said spring tensioner are formed on said head, and wherein the retainer comprises a depression and wherein said projections and grooves of said retainer are formed in said depression.

8. The hinge as recited in claim 6, wherein the spring tensioner comprises a depression and wherein said grooves and projections of said spring tensioner are formed on said depression, and wherein the retainer comprises a head and wherein said projections and grooves of said retainer are formed on said head.

9. The hinge as recited in claim 1, further comprising a first magnetic surface on said inner hinge member and a second magnetic surface on said outer hinge member, wherein the first and second magnetic surfaces have the same polarity for repelling each other when the hinge is in a closed position.

10. The hinge as recited in claim 9, wherein the inner hinge member comprises a first plate member and the outer hinge member comprises a second plate member, wherein the first magnetic surface is formed on the first plate member and the second magnetic surface is formed on the second plate member so as to repel each other when the hinge is in said closed position and the first and second plate members are adjacent to and face each other.

11. The hinge as recited in claim 10, wherein each magnetic surface is formed by inserting a magnet in the corresponding hinge members or by incorporating a magnetic paint on the corresponding hinge members.

12. A method of adjusting the torsional stop on a hinge comprising a first hinge member comprising a barrel, a second hinge member comprising a first end barrel opposite a second end barrel, wherein the barrel is coaxially aligned between the two end barrels, wherein the first hinge member can rotate relative to the second hinge member about an axis along said barrel and first and second end barrels, and a spring having a first end opposite a second end, wherein the spring second end is rotationally retained relative to the second end barrel and the spring first end is rotational retained relative to the barrel, the method comprising:

axially compressing the spring first end in a direction toward the spring second end of the spring, wherein after compressing the spring first end, said spring first end is not rotationally retained relative to the barrel;

adjusting the twist on the spring while the spring first end is compressed by rotating said spring first end relative to the spring second end; and axially decompressing said first end of the spring, wherein after decompressing, said spring first end is rotationally retained relative to said barrel.

13. The hinge as recited in claim 3, wherein the plurality of grooves of the spring tensioner are spaced from each other at intervals not greater than 10 degrees.

14. The hinge as recited in claim 3, wherein the plurality of grooves of the spring tensioner are spaced from each other at intervals not greater than 5 degrees.

15. The hinge as recited in claim 3, wherein the plurality of grooves of the spring tensioner are spaced from each other at intervals not greater than 5 degrees.

16. The hinge as recited in claim 1, further comprising a sleeve within the barrel and extending within one of said first and second end barrels, wherein said spring extends within said sleeve.

17. The hinge as recited in claim 1, further comprising a second cap mated to the second end barrel and being rotationally and axially retained relative to the second end barrel, wherein the second cap further comprises a portion comprising a depression, wherein the second end of the spring is received said depression of said second cap for rotationally retaining said second end of the spring relative to the second end barrel.

18. The method as recited in claim 12, wherein the second end of the spring is received in depression in a cap mated to the second end barrel for rotationally retaining said second axially extending end of the spring relative to the second end barrel.

19. A hinge comprising:

a first hinge member comprising a barrel;

a second hinge member comprising a first end barrel opposite a second end barrel, wherein the barrel is coaxially aligned between the two end barrels, wherein the first hinge member can rotate relative to the second hinge member about an axis along said barrel and first and second end barrels;

a spring having a first end and a second end opposite the first end;

a spring tensioner coupled to the first end of the spring, wherein the first end of the spring is rotationally retained relative to the springe tensioner, said spring tensioner comprising a depression for receiving a driver, said spring tensioner being axially slideable along the axis when being pushed by said driver; and a retainer coupled to the spring tensioner and comprising an opening that is penetrated by the driver when said driver is being received in the depression, wherein the spring second end is rotationally retained relative to the second end barrel, wherein the spring urges the spring tensioner against the retainer, and wherein when engaged with the spring tensioner, the retainer prevents the spring tensioner from rotating relative to the retainer and relative to the barrel, and wherein when being pushed by said driver, said spring tensioner slides along the axis for axially disengaging from said retainer.

* * * * *